US006276611B1

(12) United States Patent
Brooker et al.

(10) Patent No.: US 6,276,611 B1
(45) Date of Patent: Aug. 21, 2001

(54) FUEL INJECTOR NOZZLE WITH PROTECTIVE REFRACTORY INSERT

(75) Inventors: Donald Duane Brooker, Hopewell Junction, NY (US); Michael Edward Fahrion; Gary Thomas Delgrego, both of Houston, TX (US); Augustine Camacho, Bethlehem, PA (US)

(73) Assignee: Texaco Inc., White Plains, NY (US)

( * ) Notice: Subject to any disclaimer, the term of this patent is extended or adjusted under 35 U.S.C. 154(b) by 0 days.

(21) Appl. No.: 09/446,816

(22) PCT Filed: Jun. 29, 1998

(86) PCT No.: PCT/US98/13622

§ 371 Date: Mar. 20, 2000

§ 102(e) Date: Mar. 20, 2000

(87) PCT Pub. No.: WO99/01525

PCT Pub. Date: Jan. 14, 1999

Related U.S. Application Data

(63) Continuation of application No. 08/886,189, filed on Jul. 1, 1997, now Pat. No. 5,941,459.

(51) Int. Cl.[7] ..... F02D 1/06

(52) U.S. Cl. ..... 239/5; 239/8; 239/132.3; 239/397.5; 239/424

(58) Field of Search ..... 239/132.1, 132.3, 239/397.5, DIG. 19, 416.4, 416.5, 421, 5, 8, 424; 48/189.1, 72, 100

(56) References Cited

U.S. PATENT DOCUMENTS 2,183,596 * 12/1939 Trinks .
2,836,233 * 5/1958 Schoenmakers et al. .
4,301,969 * 11/1981 Sharp .
4,443,228 * 4/1984 Schlinger .
5,273,212 * 12/1993 Gerhardus et al. ..... 239/132.3

* cited by examiner

*Primary Examiner*—David A. Scherbel
*Assistant Examiner*—Dinh Q. Nguyen
(74) *Attorney, Agent, or Firm*—Morris N. Reinisch; Rodman & Rodman

(57) ABSTRACT

The fuel injector nozzle for a gasifier includes a protective refractory sheath that is flush mounted at a downstream end proximate the nozzle outlet portion. The refractory insert is of annular form to surround the nozzle outlet. The annular refractory member can be a one-piece structure or a multi-segment structure of preferably not more than four pieces. Whether the annular refractory member is a one-piece structure or a multi-segment structure, it is recessed in a downstream end surface of the fuel injector nozzle and retained in the recess by locking pins or by thread-like engagement between a projection and a groove that are provided on complementary inter-engaging surfaces of the recess and the refractory member. The retaining structure provided on the annular refractory member and at the recess in which the refractory member is disposed securely maintain the annular refractory protective member in position. The enduring presence of the annular refractory member prolongs the service life of the fuel injector nozzle by protecting the vulnerable surface areas at the downstream end of the fuel injector nozzle that are close to a hot and corrosive reaction zone within the gasifier.

9 Claims, 6 Drawing Sheets

FIG. 2
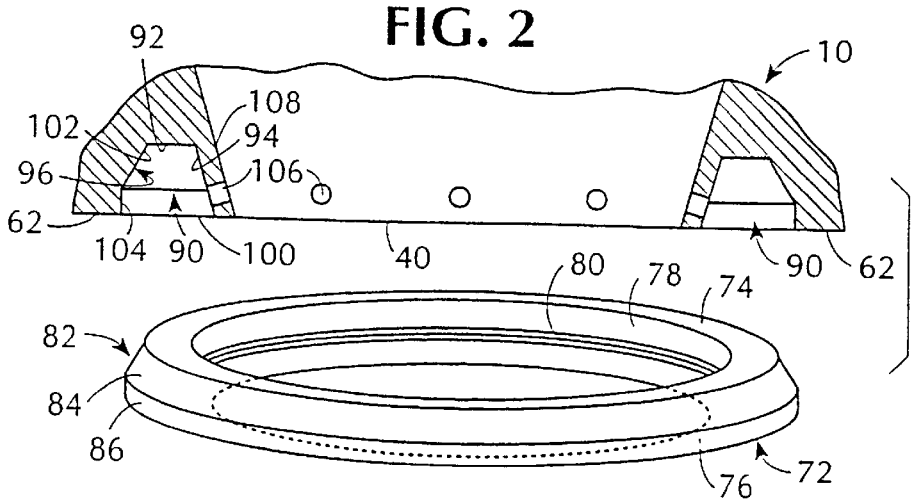
FIG. 3
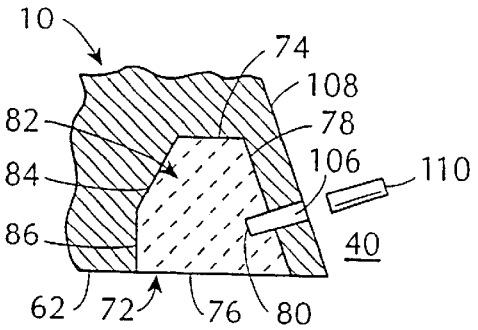
FIG. 4
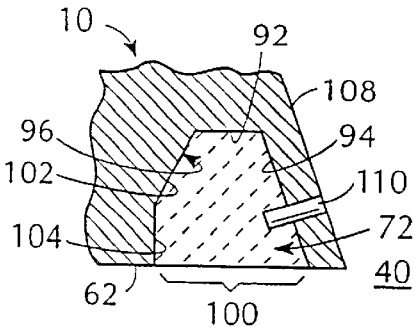
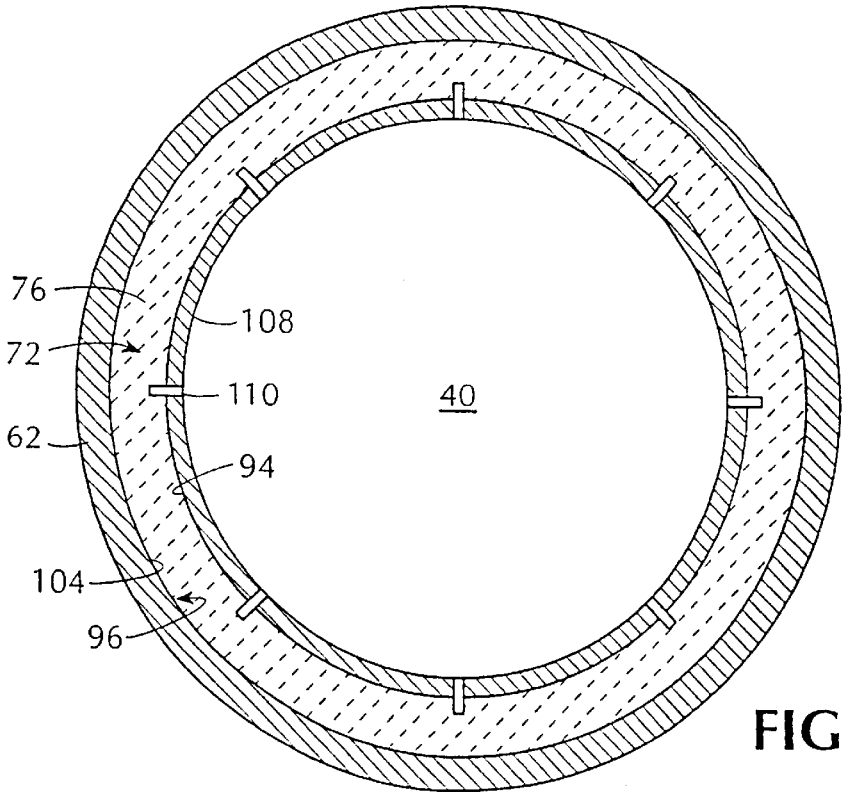
FIG. 5

FUEL INJECTOR NOZZLE WITH PROTECTIVE REFRACTORY INSERT

CROSS-REFERENCE TO RELATED APPLICATIONS

This application is a continuation of application Ser. No. 08/886,189 filed Jul. 1, 1997, now U.S. Pat. No. 5,941,459 issued Aug. 24, 1999.

BACKGROUND OF THE INVENTION

This invention is directed to fuel injector nozzles for partial oxidation gasifiers and more particularly to a novel fuel injector nozzle having a protective refractory insert at the outlet orifice to resist thermal and thermo-chemical damage to the fuel injector nozzle at the outlet orifice.

The processing of carbonaceous fuels, such as coal, gas, and oil to produce gaseous mixtures of hydrogen and carbon monoxide, such as coal gas, synthesis gas, reducing gas, or fuel gas, is generally carried out in a high-temperature environment of a partial oxidation gasifier, such as shown in U.S. Pat. No. 2,809,104. Partial oxidation gasifiers usually include annulus type fuel injector nozzles, as shown, for example, in U.S. Pat. No. 4,443,230 to Stellaccio (4 annulus fuel injector nozzle) and U.S. Pat. No. 4,491,456 to Schlinper (5 annulus fuel in to introduce pumpable slurries of carbonaceous fuels into a reaction chamber of the gasifier, along with oxygen-containing gases for partial oxidation.

In general, a water-coal slurry, which includes sulfur-containing materials, is fed into the reaction chamber of the gasifier through one or more annuli of the fuel injector nozzle. An oxygen-containing gas, flowing through other fuel injector annuli, meets with the water-coal slurry at an outlet orifice of the fuel injector nozzle and self-ignites at typical gasifier operating temperatures of approximately 2400 F. to 3000 F. Usual pressures within the gasifier environment can range from 1 to 300 atmospheres.

Within the gasifier environment, gaseous hydrogen sulfide, a well-known corrosive agent with respect to metal structure of the fuel injector nozzle, is generally formed during processing of the water-coal slurry component of the fuel feed. Liquid slag is also formed as a by-product of the reaction between the water-coal slurry and the oxygen-containing gas, and such slag also has a corrosive effect on the metal structure of the fuel injector nozzle. In addition, high temperature conditions at a reaction zone around the outlet orifice of the fuel injector nozzle due to self-ignition of the fuel feed components in this area can cause hot corrosion and thermal-induced fatigue cracking of the outlet orifice. The outlet orifice of the fuel injector nozzle generally defines the location of the highest thermal gradient zone in the gasifier.

Because of the corrosive effects of hydrogen sulfide and liquid slag on the fuel injector nozzle, especially at the outlet orifice, as well as the hot corrosion and thermal-induced fatigue cracking of the outlet orifice, failure or breakdown of the fuel injector nozzle is often likely to occur at the outlet orifice due to thermal damage and thermo-chemical degradation.

Such thermal damage and thermo-chemical degradation of the fuel injector nozzle structure limits the service life of the fuel injector nozzle, which must then be repaired or replaced. However, repair or replacement of a fuel injector nozzle is costly and inconvenient since the gasifier operation must be temporarily shut down for a cool-down period before the fuel injector can be removed for replacement or repair.

Attempts to limit fuel injector nozzle damage due to heat and corrosive agents include the provision of frusto-conical shields of thermal and wear-resistant material, such as tungsten and silicon carbide attached at the downstream end of a fuel injector nozzle, as shown in U.S. Pat. No. 4,491,456 to Schlinyer. However, the frusto-conical shield shown by Schlinzer is held in a vertical orientation and can easily slip away from the nozzle. Furthermore, any bonding materials for securing the Schlinger frusto-conical shield to the outlet end of the fuel injector nozzle may be subject to corrosion and bond failure. Failure of the bonding materials can cause the frusto-conical shield to fall away from the fuel injector nozzle. Thus, the protective service life of the Schlineer frusto-conical shield at the outlet end of the fuel injector nozzle may be prematurely reduced by a failure of the bonding agents that secure the frusto-conical shield to the fuel injector nozzle. The fuel injector nozzle is thus likely to have a reduced service life because of the premature loss of protective shielding provided by the frusto-conical shield.

Published Canadian Application 2,084,035 to Gehardus et. al. shows a burner for production of synthesis gas wherein the end surface is clad with ceramic platelets held in place by a dovetail joint. The dovetail joint creates a non-uniform thickness of the orifice wall at the dovetail joint and has a undesirable area of reduced wall thickness. The area of reduced wall thickness is a stress concentration area that is vulnerable to cracking and thermal damage. The non-uniform wall thickness at the dovetail joint can also lead to accelerated wear and corrosion. In addition the dovetail joint forms a narrow support neck for the ceramic platelets. The narrow support neck is an area of weakness and vulnerability of the platelets to damage or separation from the burner.

It is thus desirable to provide a fuel injector nozzle with a protective refractory insert that is securely retained at the outlet orifice of the fuel injector nozzle and which refractory insert replaces metal in the highest thermal gradient zone of the fuel injector nozzle. It is also desirable to provide a fuel injector nozzle with a protective refractory insert that remains in position under conditions which promote heat and hydrogen sulfide assisted thermal fatigue corrosion damage, whereby the enduring presence of the protective refractory insert extends the service life of the fuel injector nozzle.

OBJECTS AND SUMMARY OF THE INVENTION

Among the several objects of the invention may be noted the provision of a novel fuel injector nozzle having thermal and thermo-chemical protection at the outlet orifice, a novel fuel injector nozzle having a protective thermal and thermo-chemical insert secured to the outlet orifice using retaining means that mechanically lock the protective insert around the outlet orifice, whereby the retaining means are not subject to premature failure by corrosive agents or thermal phenomena, and the insert and retaining means allow latitude for thermally induced deformation processes that occur during start-up operation of the gasifier.

A further object of the invention is to provide for thermal and thermo-chemical protection around the outlet orifice of the fuel injector nozzle at relatively low cost by using refractory shapes that are interlocked with the fuel injector nozzle. Another object of the invention is to provide a fuel injector nozzle with a refractory insert that replaces metal that is likely to be damaged by the process reactions. Still another object of the invention is to provide a novel method of extending the life of a fuel injector nozzle.

Another object of the invention is to provide a fuel injector nozzle with a novel protective refractory insert that is flush mounted around the outlet orifice of the fuel injector nozzle.

Other objects and features of the invention will be in part apparent and in part pointed out hereinafter.

In accordance with the invention, an annular refractory insert is interlocked with the fuel injector nozzle at a downstream end proximate the nozzle outlet end portion.

A recess formed in the downstream end of the fuel injector nozzle accommodates the annular refractory insert. The recess can be of trapezoidal shape in cross-section, the term "trapezoidal" being understood to contemplate shapes that are trapezoidal-like. Other suitable cross-sectional shapes of the recess are within the concept of the invention.

Disposition of the annular refractory insert in the recess includes interlocking of the refractory insert to the fuel injector nozzle by locking or latching devices that obviate the need for cement or bonding material. The insert does not extend beyond the outlet end surface of the fuel injector nozzle and is thus flush mounted at the outlet orifice end surface.

In one embodiment of the invention, the annular refractory insert is a one-piece member held in position in the recess by means of locking pins that engage a groove formed around the circumference of the annular insert.

In a second embodiment of the invention, the annular insert is formed as a multi-segment structure. The segments are held in place in a trapezoidal recess by boss-like protrusions formed on side walls of the recess that engage peripheral grooves formed in corresponding side walls of the annular insert segments.

In a further embodiment of the invention, a metallic retaining ring is secured to the outlet end of the fuel injector nozzle after the annular insert segments are installed in an installation recess. The metallic retaining ring completes the structure of a trapezoidal recess, and also completes the locking structure that serves to retain the annular refractory segments within the recess.

The multiple segments of the annular refractory insert preferably have stepped end portions that also interengage when positioned in the recess. The step-wise engagement of the insert segments restrict passage of corrosive gases and slag past the insert segments to the underlying metallic structure of the fuel injector nozzle.

In all embodiments of the invention, the annular refractory insert protects the downstream area of the fuel injector nozzle at the nozzle outlet end portion from thermal and thermo-chemical damage due to high temperature conditions and corrosive chemical conditions at a reaction zone in the gasifier. The annular refractory insert thus extends the service life of the fuel injector nozzle and correspondingly extends an operating cycle of the gasifier.

The invention accordingly comprises the constructions and method hereinafter described, the scope of the invention being indicated in the claims.

DESCRIPTION OF THE DRAWINGS

In the accompanying drawings,

FIG. 2 is an exploded view thereof showing the annular refractory insert prior to installation at the outlet orifice of the fuel injector nozzle, the inner annuli of the fuel injector nozzle being omitted herein and in subsequent figures for purposes of clarity;

FIGS. 3 and 4 are enlarged fragmentary sectional views of the annular refractory insert positioned at the outlet orifice for pin securement;

FIG. 5 is a bottom sectional view taken at the downstream end thereof and showing the outlet orifice after installation of the annular refractory insert;

Corresponding reference numbers indicate corresponding parts throughout the several views of the drawings.

DETAILED DESCRIPTION OF THE INVENTION

Figure 1:
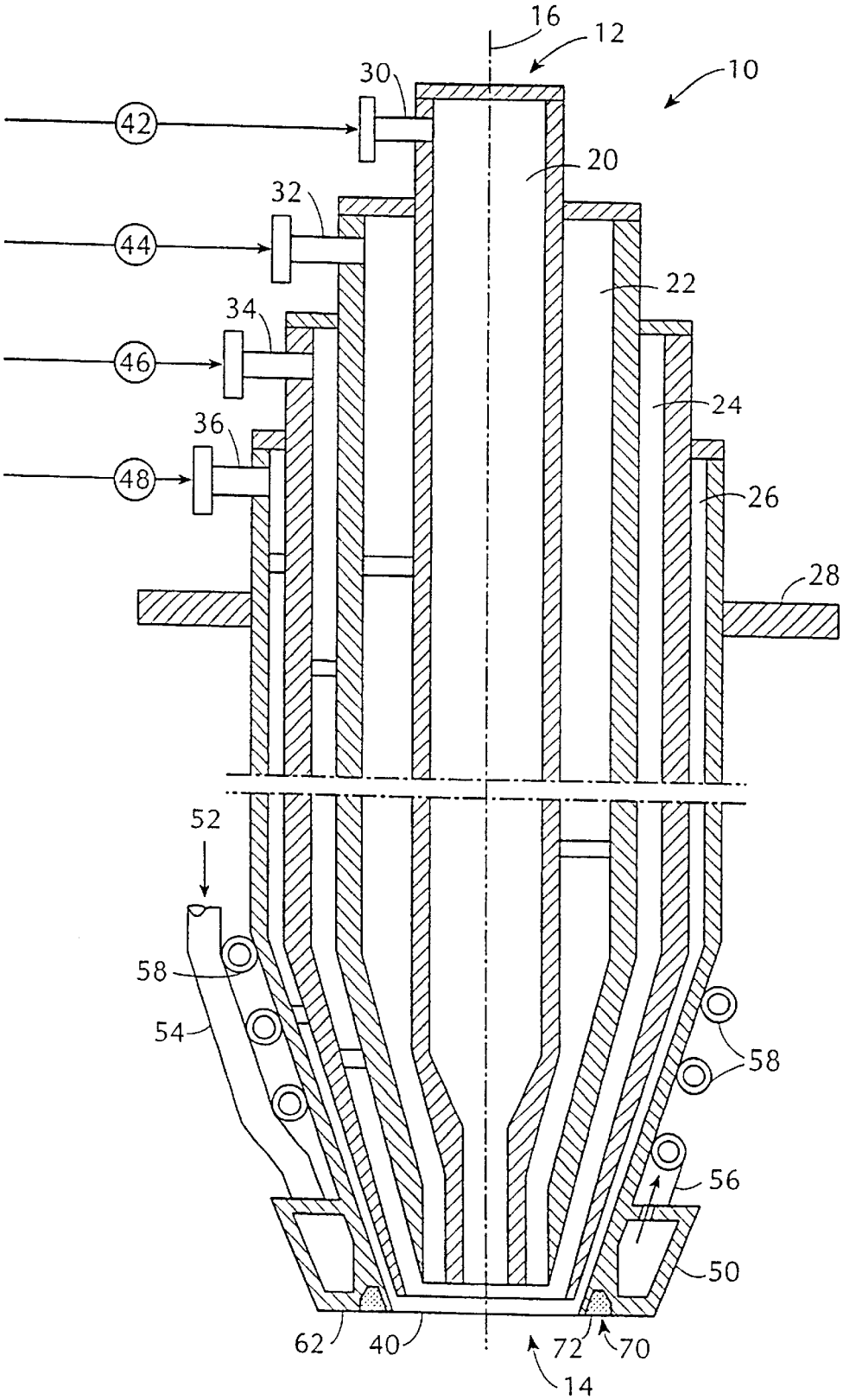
FIG. 1 is a simplified schematic elevation view, partly shown in section, of a multi-annulus fuel injector nozzle with an annular refractory insert incorporating one embodiment of the invention.

A fuel injector nozzle incorporating one embodiment of the invention is generally indicated by the reference number 10 in FIG. 1. The fuel injector nozzle 10 is similar to the fuel injector nozzle described in detail in U.S. Pat. No. 4,443,230 to Stellacio.

The fuel injector nozzle 10 is of the type used for partial oxidation gasifiers, and has an upstream end 12 and a downstream end 14. The fuel injector nozzle 10, which has cylindrical symmetry about a central axis 16, further includes a central feed stream conduit 20 and concentric annular feed stream conduits 22, 24 and 26 that converge to form a nozzle outlet end 40 at the downstream end 14. An annular mounting flange 28 joined to the conduit 26 is arranged to be supported at an open inlet end of the gasifier reaction chamber (not shown) to permit the nozzle outlet end 40 to be suspended in the reaction chamber.

The conduits 20, 22, 24 and 26 include respective inlet pipes 30, 32, 34 and 36. The inlet pipe 30 provides a feed stream of gaseous fuel material 42 such as, for example, from the group of free oxygen-containing gas, steam, recycled product gas and hydrocarbon gas. The inlet pipe 32 provides a pumpable liquid phase slurry 44 of solid carbonaceous fuel such as, for example, a coal-water slurry. The inlet pipes 34 and 36 provide two separate.streams of fuel 46 and 48, such as, for example, free oxygen-containing gas optionally in admixture with a temperature moderator.

The oxygen-containing gas 42, carbonaceous slurry stream 44, and free oxygen-containing gas streams 46 and 48 from the conduits 20, 22, 24 and 26 merge at a predetermined distance beyond the nozzle outlet end 40 at a predetermined location in the gasifier reaction chamber (not shown) to form a reaction zone (not shown). The merging of the carbonaceous slurry 44 exiting the conduit 22 with the oxygen-containing streams 42, 46 and 48 from the conduits 20, 24 and 26 causes the carbonaceous.slurry 44 to break up or atomize, which promotes product reaction and enhances the heat-induced gasification process. As a result, the reaction zone at the downstream end 14 of the fuel injector nozzle 10 is characterized by intense heat, with temperatures ranging from 2400 F. to 3000 F.

An annular coaxial water-cooling jacket 50 is provided at the downstream end 14 of the fuel injector nozzle 10 to surround the outlet orifice 40. The annular cooling jacket 50 receives incoming cooling water 52 through an inlet pipe 54. The cooling water 52 exits at 56 from the annular cooling jacket 50 into a cooling coil 58 and exits from the cooling coil 58 in any suitable known recirculation or drainage device (not shown).

The outlet orifice 40 includes an annular horizontal surface or downstream end surface 62 at the downstream end 14 which is exposed to the hot reaction zone of the gasifier and is the site of high thermal gradients. The outlet orifice 14 is thus vulnerable to chemical and hot corrosion and thermal-induced fatigue cracking that often leads to operational problems of the fuel injector nozzle 10.

To deal with the problem of thermal and thermo-chemical degradation of the fuel injector nozzle 10 at the outlet orifice 40, a protective refractory member 70 is provided at the annular surface 62 proximate the outlet orifice 40. The protective refractory member 70 includes a one-piece annular insert 72 formed of a suitable refractory material, which can be of a ceramic type, such as silicon carbide, silicon nitride or any other suitable known advanced ceramic composite. The annular insert 72 can be molded, machined or otherwise formed in any suitable known manner.

Referring to FIGS. 2 and 3, the insert 72 has a trapezoidal-like shape in cross-section with a relatively narrow upper base 74 and a relatively wide lower base 76. The terms "trapezoidal" or "trapezoidal shape," as used hereinafter, are intended to refer to trapezoidal-like shapes. A radially inner side 78 joins the upper and lower bases 74 and 76 at one side of the trapezoidal shape. A circumferential groove 80 formed in the radially inner side 78 is inclined at an angle that is substantially perpendicular to the radially inner side 78. The insert 72 further includes a radially outer side 82 composed of intersecting side portions 84 and 86 that join the upper and lower bases 74 and 76 of the trapezoidal shape. If desired, the radially outer side 82 can be formed with a continuous slope.

Referring to FIGS. 2 and 4, an annular channel 90 with a trapezoidal cross-section is formed in the metal annular surface 62 and has a shape and magnitude that are substantially complementary with the trapezoidal shape of the insert 72 so as to accommodate the insert 72. The channel 90 is in close proximity to the outlet orifice 40. The channel 90 includes an upper base portion 92 corresponding to the upper base portion 74 of the insert 72, an inner radial surface 94 corresponding to the radially inner surface 78 of the insert 72, an outer radial side 96 corresponding to the outer radial side 82 of the insert 72, and a channel opening 100 corresponding to the lower base 76 of the insert 72. The outer radial side 96 of the channel 90 is composed of intersecting side portions 102 and 104 that correspond to the intersecting side portions 84 and 86 of the insert 72.

A plurality of equally spaced pin openings 106 are provided in an inclined downstream orifice wall surface 108 at the outlet orifice 40. The pin openings 106 pass through the inner radial surface 94 of the channel 90 and register with the annular groove 80 of the refractory insert 72. The pin openings 106 are at substantially the same angle as the groove 80 relative to the wall surface 78. The outlet orifice wall surface 108 defines a flow path for portions of fluid or mass moving from the outlet orifice 40 of the fuel injector nozzle 10.

Assembly of the refractory insert 72 to the fuel injector nozzle 10 is accomplished by placing the insert 72 in the channel 90, such that the insert surfaces 74, 78, 84 and 86 are in substantial surface-to-surface contact with the corresponding channel surfaces 92, 94, 102 and 104. If desired, the channel surfaces 92, 94, 102 and 104 can be coated with a suitable known bonding material, such as silicon carbide mortars, Teflon® or other suitable known high temperature adhesive, prior to installation of the refractory insert 72. Also, if desired, a coating of silicon dioxide can be applied to the surface 76 of the insert 72 to enhance the thermal and thermo-chemical resistance of the annular insert 72.

A locking pin 110 formed of a suitable steel alloy such as ALLOY 800 made by International Nickel Co. is pressed into each of the pin openings 106 to engage the groove 80 of the refractory insert 72, as shown in FIGS. 3 and 4. Thus, upon disposition of the refractory insert 72 in the channel 90, the locking pins 110 are driven into the groove 80 to lock the refractory insert 72 into the channel 90, as shown in FIG. 5.

Under this arrangement the base surface 76 of the insert 72 is an exposed end surface and is substantially coplanar or flush with the annular downstream end surface 62 of the fuel injector nozzle 10. This flush mounting arrangement helps ensure that the fuel injector nozzle 10 with the refractory insert 72 not only resists thermal and thermo-chemical cracking and corrosion but remains in position under adverse high temperature and corrosive conditions within the gasifier. Furthermore the flush mounting arrangement does not affect the process flow even if the fuel injector nozzle becomes damaged by cracking.

Although the dimensions of the channel 90 and the annular refractory insert 72 are a matter of choice, the size of the channel 90 (which determines the size of the insert 72) can be, for example, approximately ¼ to ¾ inches deep from the opening 100 to the base 92, approximately ⅜ to ¾ inches wide at the surface 76, approximately ⅛ to ⅝ inches wide at the surface 92, and approximately 4 to 6 inches in diameter at the inner radial surface 94. The wall thickness of the wall 108 (FIG. 2) at the channel 90 is approximately 1/64 to ⅛ inches. The width of the annular groove 80 is approximately 1/64 to ⅛ inches and the diameter of the locking pin 100 can be approximately 1/64 to ⅛ inches.

The annular refractory insert 72 is thus mechanically interlocked to the downstream end of the fuel injector nozzle 10 proximate the outlet orifice 40. The annular horizontal surface 62 at the downstream end 14 has direct exposure to the reaction zone of the fuel injector nozzle and thereby derives substantial protection from the disclosed positioning and securement of the protective refractory member 70 at such annular horizontal surface 62. Since the annular refractory insert 72 of the protective member 70 is mechanically interlocked via the locking pins 10 to the fuel injector nozzle structure, and such locking pins have greater strength and durability than mortar, the locking pins prolong the life of the refractory member 70 as a protective agent for the outlet end 40 of the fuel injector nozzle 10.

The submergence or recession of the annular refractory insert 72 within the metal structure of the fuel injector nozzle at the outlet nozzle end 40 ensures that the annular refractory insert 72 provides the desired protection without substantial surface exposure to the adverse conditions at the reaction zone of the gasifier. The service life of the fuel injector nozzle is thus prolonged by increasing the resistance to thermal damage and thermo-chemical degradation of the nozzle outlet end 40 of the fuel injector nozzle.

Figure 6:
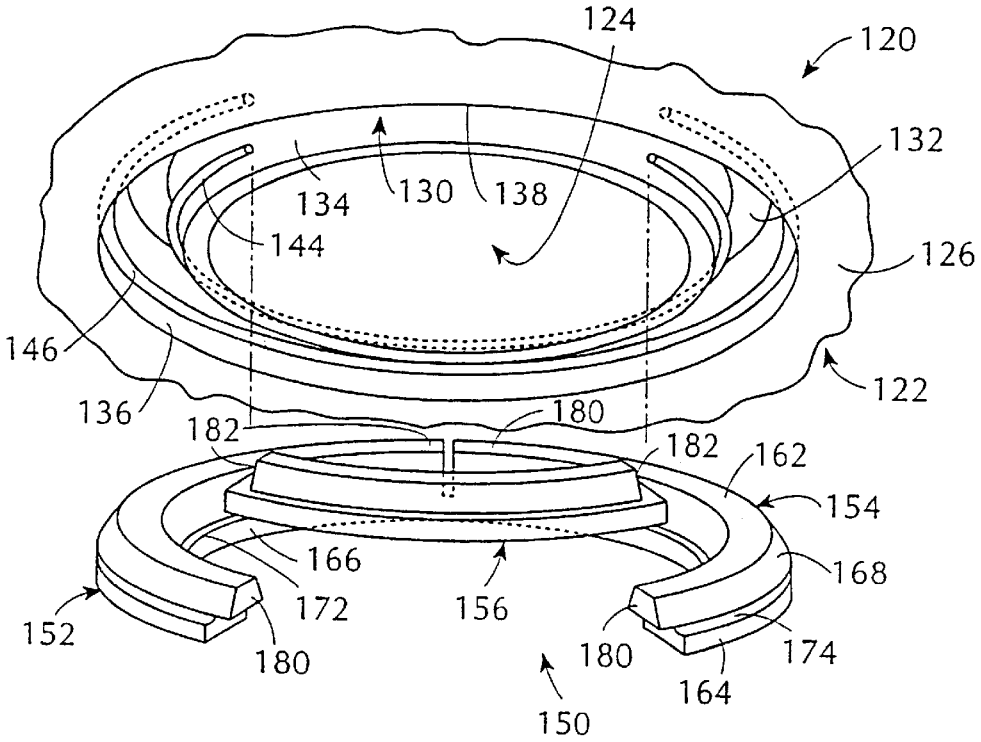
FIG. 6 is a simplified exploded perspective view of another embodiment of the invention, wherein a multi-segment annular refractory insert is positioned for installation at the outlet orifice of a multi-annulus fuel injector nozzle.

Another embodiment of the fuel injector nozzle is generally indicated by the reference number 120 in FIG. 6. The fuel injector nozzle 120 is structurally similar to the fuel injector nozzle 10, except where otherwise indicated. The fuel injector nozzle 120 has a downstream end 122 with an outlet orifice 124 and a horizontal annular surface 126 at the downstream end of the outlet orifice 124. A trapezoidal channel 130 (FIG. 6) corresponding to the channel 90 of the fuel injector nozzle 10 (FIG. 2) is formed in the annular surface 126.

Figure 7:
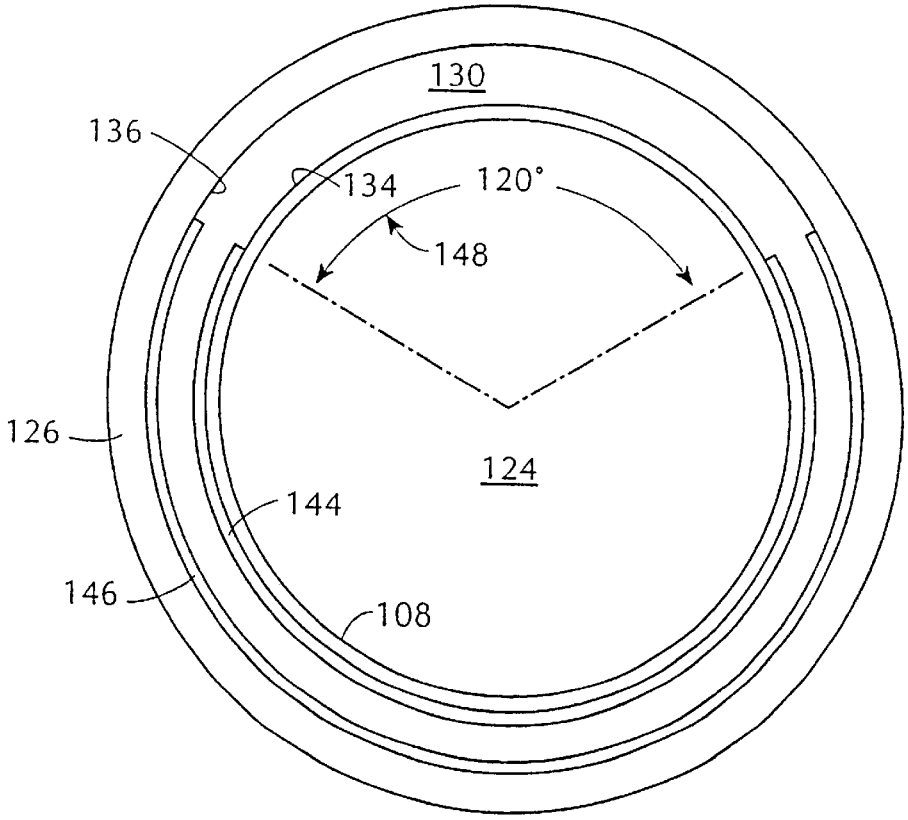
FIG. 7 is a simplified schematic bottom view thereof prior to installation of the multi-segment annular refractory insert at the outlet orifice.
Figure 10:
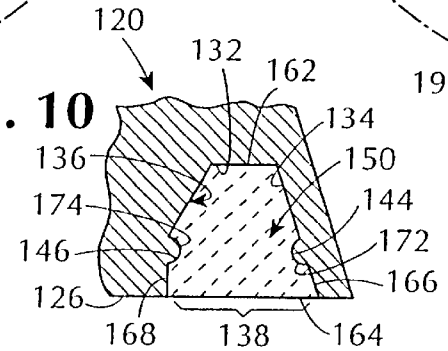
FIG. 10 is an enlarged fragmentary sectional view thereof taken on the line 10—10 of FIG. 8.

As shown most clearly in FIG. 10, the channel 130 includes an upper base surface 132, an inner radial surface 134, an outer radial surface 136 and a channel opening 138. A thread-like boss 144 is formed on the inner radial surface 134, and extends approximately 240° around the channel 130. A corresponding thread-like boss 146 is formed on the outer radial surface 136, and also extends approximately 240° around the channel 130 in arcuate alignment with the boss 144. Thus, a 120° arc portion 148 (FIG. 7) of the channel 130 is free of the thread-like bosses 144 and 146.

The thread-like bosses 144 and 146 are located at approximately one-third of the distance between the channel opening 138 and the upper base 132. The bosses 144 and 146 are of generally semi-elliptical or semi-circular cross-section, although other suitable shapes are feasible.

Referring to FIG. 6, the fuel injector nozzle 120 further includes a multi-segmented annular insert 150, formed of the same material as the annular insert 72. The insert 150 is of complementary trapezoidal shape with respect to the channel 130, and includes three segments 152, 154 and 156, each having an arcuate extent of approximately 120°.

As most clearly shown in FIG. 10, each of the segments 152, 154 and 156 include a relatively narrow upper surface 162, a relatively wide lower surface 164, a radially inner surface 166, and a radially outer surface 168 that correspond to the channel opening 130 and the channel surfaces 132, 134 and 136.

An inner circumferential groove 172 is formed on the radially inner side 166 of the segments 152, 154 and 156 to receive the boss 144, and an outer circumferential groove 174 is formed in the outer radial sides 168 of the segments 152, 154 and 156 to receive the boss 146.

Figure 11:
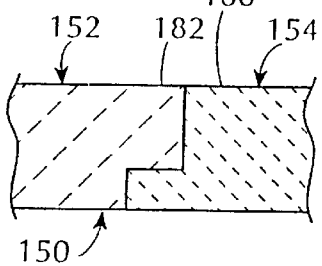
FIG. 11 is an enlarged fragmentary sectional view thereof taken on the line 11—11 of FIG. 8.
Figure 12:
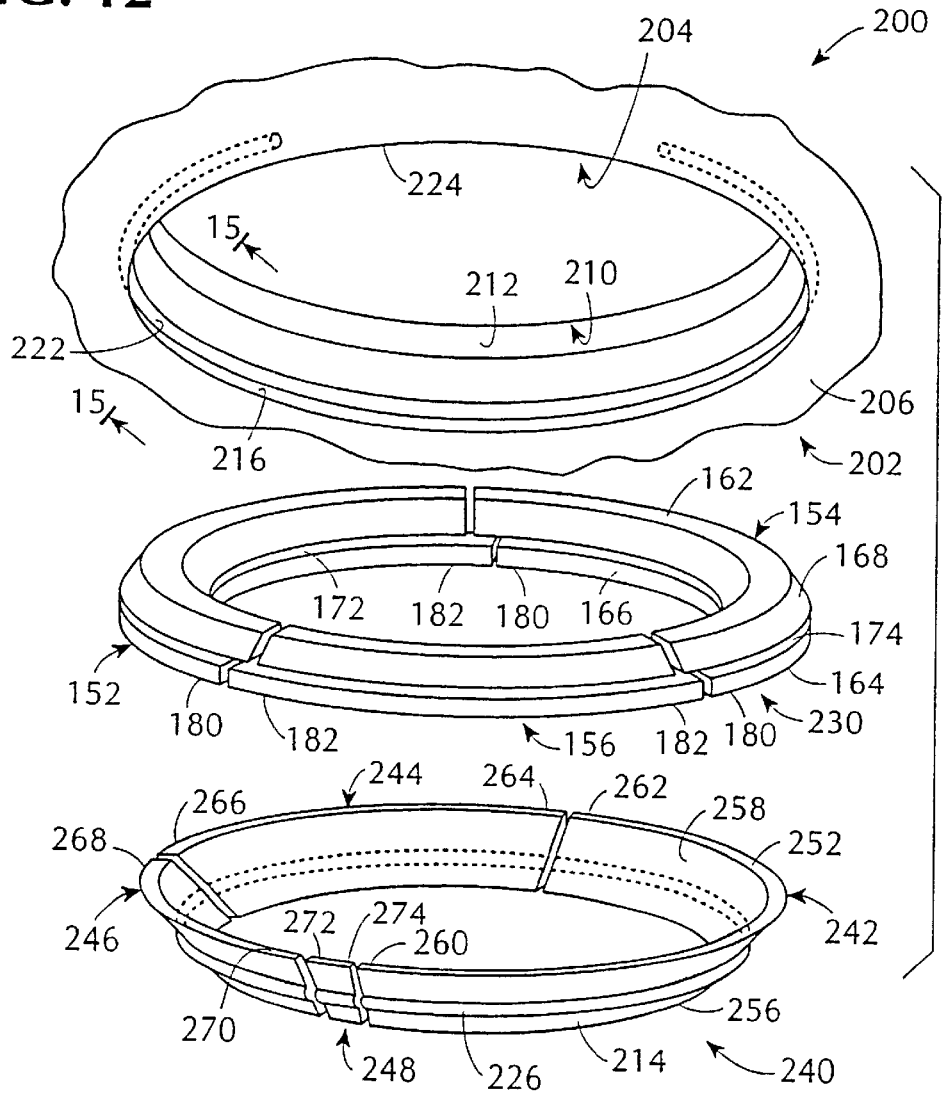
FIG. 12 is an exploded perspective view of another embodiment of the invention wherein a multi-segment retaining ring is used to lock a multi-segment annular refractory insert at the outlet orifice of a fuel injector nozzle.

The end portions of each of the segments 152, 154 and 156 are stepped, as indicated by the reference numbers 180 and 182, to permit step-wise engagement of the segments, as most clearly shown in FIGS. 11 and 12. Thus, one end of the segment 152 includes the descending step 182 engageable with the complementary-shaped ascending step 180 at an adjoining end of the segment 154. The opposite ends of each of the segments 152 and 154 include an ascending step 180. The segment 156 has opposite end portions that are each formed with the descending step 182.

The segments 152, 154 and 156 are located in the channel 130 by disposing such segments, one by one, into the boss-free section 148 of the channel 130, and sliding the segments into the portion of the channel 130 that includes the bosses 144 and 146.

It should be noted that the boss-free section 148 of the channel 130 has an arcuate extent that is slightly larger than the arcuate extent of the largest segment of a multi-segment insert. Although the insert 150 includes three segments of approximately equal arc, each segment need not be of equal size. Preferably the insert should not exceed four segments.

Figure 8:
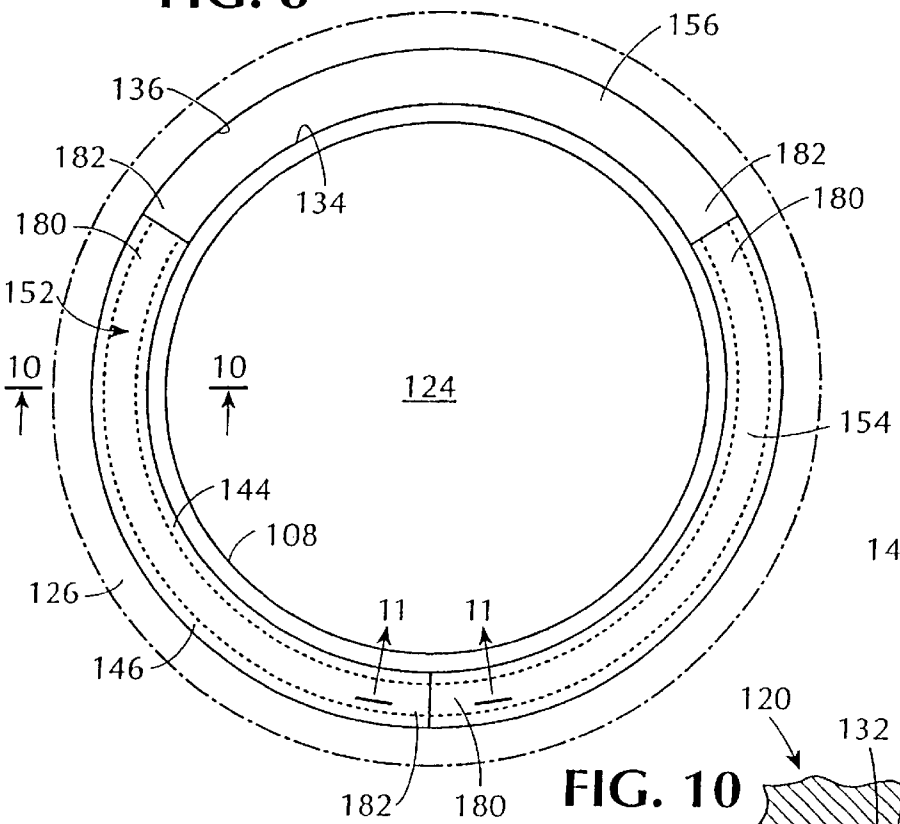
FIG. 8 is a view similar to FIG. 7 showing an intermediate installation position of the annular refractory insert segments at the outlet orifice of the fuel injector nozzle.

Thus, the segment 152 is disposed into the boss-free section 148 (FIG. 7) of the channel 130, and threaded in a counter-clockwise direction to the position shown in FIG. 8. The next segment 154 is disposed in the boss-free section 148 of the channel 130, and threaded in a clockwise direction to the position shown in FIG. 8, wherein the stepped end portions 180 and 182 engage, as shown in FIG. 11.

Figure 9:
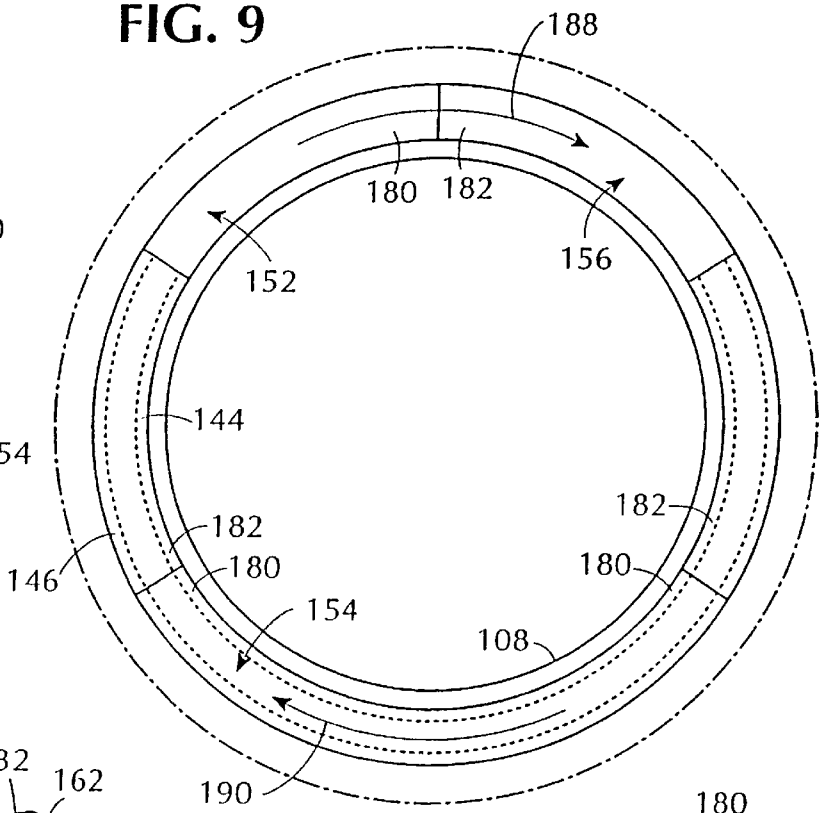
FIG. 9 is a view similar to FIG. 8 showing a final installation position of the annular refractory inserts.

The remaining segment 156 is disposed in the boss-free section 148, such that the ascending steps 180 at each end of the segment 156 engage the respective descending steps 182 at the corresponding ends of the segments 152 and 154. When all three segments 152, 154 and 156 are located in the channel 130, they are rotated approximately 60 degrees in a clockwise direction, for example, as indicated by the arrows 188 and 190 in FIG. 9. Thus, a portion of the segments 152 and 156 are engaged by the boss-like threads 144 and 146, whereas the full arcuate extent of the segment 154 is engaged by the boss-like threads 144 and 146. Under this arrangement, each of the segments 152, 154 and 156 has at least 60 degrees engagement with the inner and outer boss-like threads 144 and 146.

The segments 152, 154 and 156 are thus keyed into the channel 130 by inter-engagement between the boss-like channel threads 144 and 146 and the segment grooves 172 and 174. Such inter-engagement serves to maintain the segments 152, 154 and 156 securely within the channel 130. Furthermore, the step-wise engagement of the opposite ends of each of the segments 152, 154 and 156 minimize the prospect of corrosive materials reaching the surface 92 of the channel 130.

If desired, the step-like engaged end portions 180 and 182 of each of the segments 152, 154 and 156 can be joined with ceramic mortar or any other suitable known bonding material. Bonding material can likewise be applied to the surface of the channel 140 during installation of the segments 152, 154 and 156. The step-like joints 180 and 182 at the ends of each of the segments 152, 154 and 156 help resist penetration of corrosive liquid slag and hydrogen sulfide past the ceramic segments.

The multi-segment annular ring permits expansion and contraction of the segments, and the step-like engaged end portions minimize penetration of corrosive materials past the ceramic segments, even if there is no bonding material provided between the step-like engaged end portions 180 and 182 of each of the segments 152, 154 and 156.

Another embodiment of the fuel injector nozzle is generally indicated by the reference number 200 in FIG. 12. The fuel injector nozzle 200 is structurally similar to the fuel injector nozzle 10, except where otherwise indicated. The fuel injector nozzle 200 has a downstream end 202 with an outlet orifice 204 and a horizontal annular surface 206 at the downstream end of the outlet orifice 204.

Figure 15:
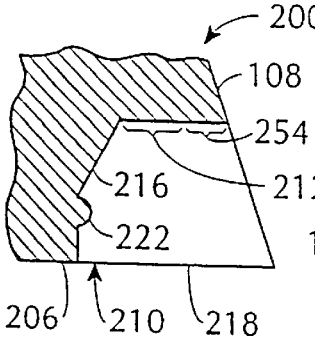
FIG. 15 is an enlarged fragmentary sectional view thereof taken on the line 15—15 of FIG. 12 prior to installation of the multi-segment retaining ring.
Figure 17:
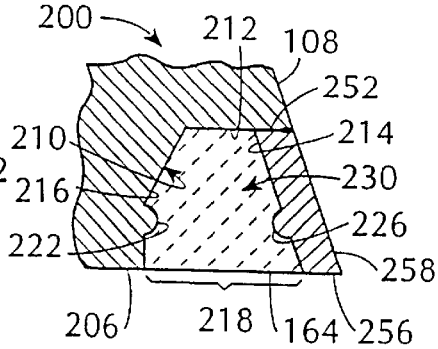
FIG. 17 is an enlarged fragmentary sectional view thereof taken on the line 17—17 of FIG. 14.

A trapezoidal channel 210 shown partially in FIGS. 12 and 15, and completely in FIG. 17, corresponds to the channel 90 of the fuel injector nozzle 10 and is provided in the horizontal annular surface 206. The trapezoidal channel 210 includes an upper base portion 212, an inner radial surface 214 (FIG. 17), an outer radial surface 216, and a base opening 218 (FIG. 17).

A thread-like boss 222 is formed at the outer radial surface 216 and has an arcuate extent of approximately 240 degrees around the surface 216. Thus, a 120-degree arc of the surface 216, indicated by the reference number 224 in FIG. 12, is free of the thread-like boss 222. A thread-like boss 226 (FIG. 17) is formed at the inner radial surface 214 of the channel 210 and extends entirely around the channel.

Referring to FIG. 12, the fuel injector nozzle 200 further includes a multi-segmented refractory annular insert 230, identical to the multi-segment refractory annular insert 150 of the fuel injector nozzle 120.

The fuel injector nozzle 200 also includes a multi-segment metallic retention ring 240, including four segments 242, 244, 246 and 248. The metallic ring segment 242 has an arcuate extent of approximately 180 degrees. The metallic ring segment 244 has an arcuate extent of approximately 120 degrees. The ring segment 246 has an arcuate extent of approximately 50 degrees and the ring segment 248 has an arcuate extent of approximately 10 degrees. Each of the ring segments 242, 244, 246 and 248 have an outer radial surface 214 with the thread-like boss 226.

The outer radial surface 214 of the retaining ring 240, as shown in FIG. 12, also constitutes the inner radial surface 214 of the channel 210, as shown in FIG. 17. The ring segments 242, 244, 246 and 248 also include an upper edge 252 that engages an adjoining surface 254 (FIG. 16) adjacent the upper base 212 of the trapezoidal recess 210. The ring segments 242, 244, 246 and 248 further include a radially inner surface 258 and lower edge 256 (FIG. 17) that corresponds to the lower surface 164 of the annular insert 230.

Figure 13:
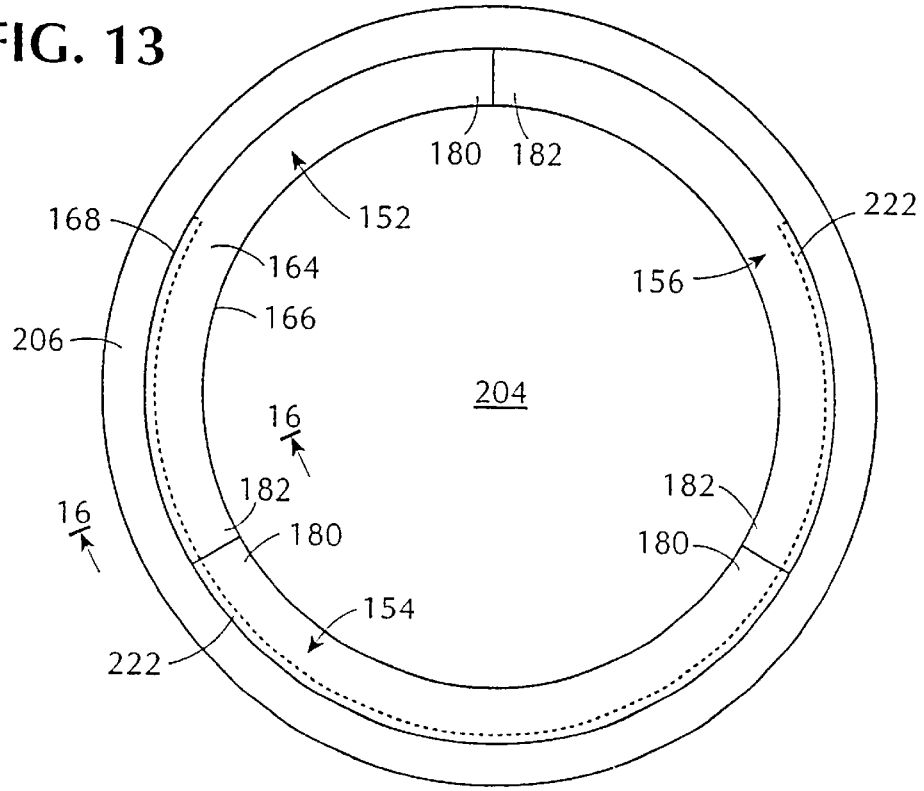
FIG. 13 is a simplified schematic bottom view thereof showing an intermediate installation position of the multi-segment annular refractory inserts at the outlet orifice of the fuel injector nozzle.

The insert segments 152, 154 and 156 of the annular refractory insert 230 are assembled to the downstream end 202 of the fuel injector nozzle 200 before the retaining ring 240 is installed. For example, the insert segment 152 is placed in the boss-free section 224 of the recess 210, and shifted around the recess 210 in a manner similar to that previously described for installing the annular insert 150, to permit inter-engagement between the thread-like boss 222 and the thread-like groove 174. The insert segment 152 is shifted entirely clear of the boss-free section 224. The next insert segment 154 is disposed in the boss-free section 224 and likewise shifted in a manner similar to that previously described, such that the boss 222 engages the groove 174 of the insert segment 154. The insert segment 154 is also shifted out of the boss-free section 224 to fully engage the boss 222. The remaining insert segment 156 is disposed in the boss-free section 224, and shifted approximately 60 degrees in a manner similar to that previously described, to the position shown in FIGS. 13, such that the boss 222 engages approximately 60 degrees of the groove 174 of the insert segments 152 and 156, whereas the entire insert segment 154 is inter-engaged with the boss 222, as most clearly shown in FIG. 13.

The stepped end sections 180 and 182 of each of the insert segments 152, 154 and 156 engage in a manner similar to that previously shown and described.

Figure 14:
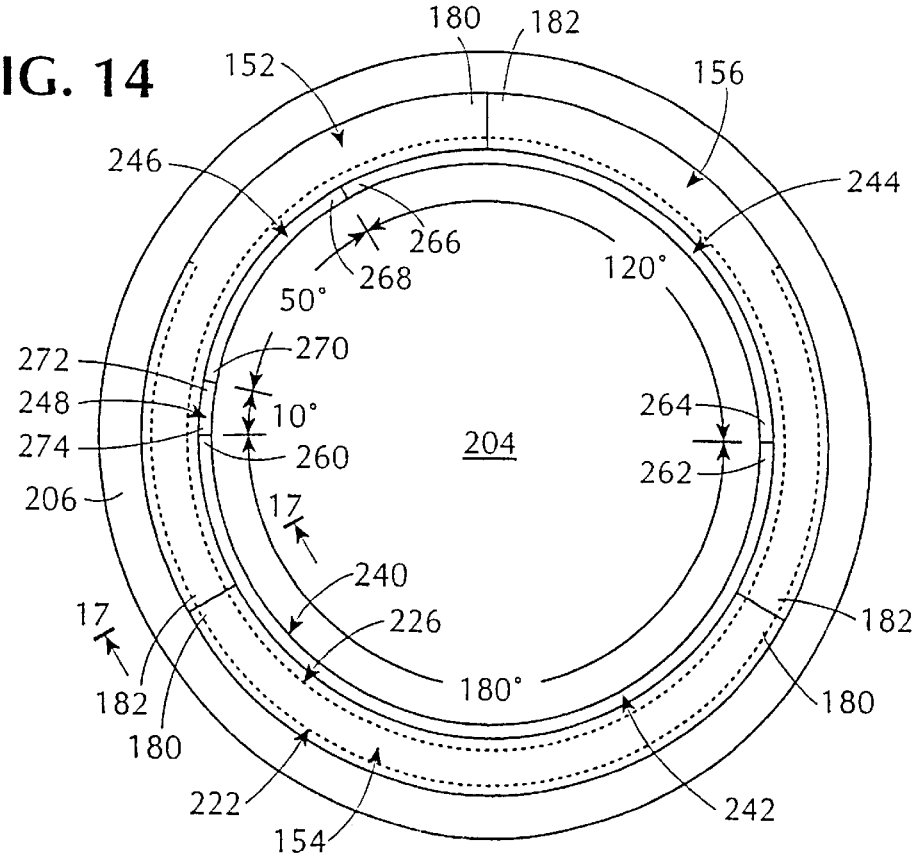
FIG. 14 is a view similar to FIG. 13 showing a finished installation arrangement of the multi-segment annular refractory insert and the multi-segment retaining ring at the outlet orifice of the fuel injector nozzle.

After the insert segments 152, 154 and 156 are thus installed, they are securely locked in position by the retaining ring 240. The retaining ring segments 242, 244 and 246 are sequentially positioned as shown in FIGS. 14 and 17, such that the boss 226 of the ring segments engages the groove 172 of the insert segments 152, 154 and 156. The ring segment 248 is pressed into position to complete the retaining ring circumference and to constitute the radially inner wall surface 214 of the trapezoidal recess 210 that accommodates the annular insert 230.

Figure 16:
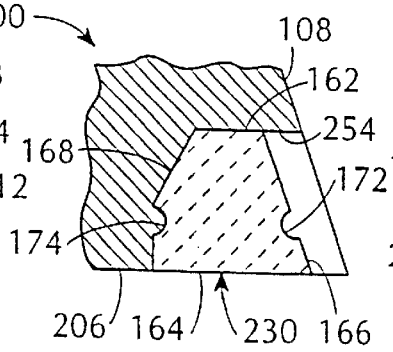
FIG. 16 is an enlarged fragmentary sectional view taken on the line 16—16 of FIG. 13.

The upper edge 252 of the retaining ring segments 242, 244, 246 and 248 are welded or otherwise suitably secured against the adjoining surface 254 (FIGS. 16 and 17). The ring segment end portions 262, 264, 266, 268, 270, 272 and 274 (FIGS. 12 and 14) are also welded together to form an integral retention ring for locking the insert segments 152, 154 and 156 to the downstream end 202 of the fuel injector nozzle 200 at the outlet orifice 204.

Preferably the end portions 262–274 of the retaining ring segments 242–248 are staggered with respect to the stepped end portions 180 and 182 of the insert segments 152–156. If desired, a suitable known high temperature adhesive can be provided on the outer radial surface 214 of the retaining ring segments 242–248 and the inner radial surface 166 of the insert segments 152–156.

It should be noted that, since the arcuate extent of the retaining ring segments 242, 244 and 246 is approximately 360 degrees, the retaining ring segment 248 can be replaced by a weld formation. Other different arcuate size combinations of the retaining ring segments can be used as a matter of choice. The number of retaining ring segments is also a matter of choice, although a minimum of two retaining ring segments is preferred.

Under this arrangement, the fuel injector nozzle 200 is provided with a protective refractory insert at the outlet nozzle 204, which is relatively easy to install. The refractory ring 230 is securely retained within the channel 210, without the need for bonding materials, which are optional, as is the case in all embodiments of the invention.

Some advantages of the invention evident from the foregoing description include a fuel injector nozzle with a protective annular refractory insert that is flush mounted at the downstream end proximate the nozzle outlet portion. The protective refractory insert can be easily installed, repaired or replaced, and is mechanically secured to interlock with the fuel injector nozzle structure. The protective refractory insert allows uniform wall thickness between the insert and the outlet orifice and thus withstands thermal damage and thermo-chemical degradation, better than the metal it replaces. The protective refractory insert thereby prolongs the service life of the fuel injector nozzle.

In view of the above, it will be seen that the several objects of the invention are achieved, and other advantageous results attained.

As various changes can be made in the above constructions and method without departing from the scope of the invention, it is intended that all matter contained in the above description or shown in the accompanying drawings shall be interpreted as illustrative and not in a limiting sense.

What is claimed is:

1. A method of protecting a fuel injector nozzle having a fuel injector body with an upstream end and a downstream end, at least two conduits extending from the upstream end to the downstream end to permit segregated flow of a stream of oxygen containing gas and a stream of carbonaceous fuel from the downstream end, the downstream end of the fuel injector nozzle having an outlet orifice and a downstream end surface, said method comprising a) forming an annular recess in a portion of the downstream end surface, b) disposing a refractory insert in the annular recess such that the refractory insert does not project beyond the downstream end surface and does not cover the downstream end surface alongside the annular recess, and, c) securing the refractory insert in the annular recess to prevent the refractory insert from falling away from the annular recess when the fuel injector nozzle is positioned such that the downstream end surface faces a downward direction.

2. The method of claim 1 including forming the refractory insert as a one piece member.

3. The method of claim 1 including forming the refractory insert from a plurality of refractory segment members.

4. The method of claim 3 including securing the refractory insert in the annular recess by forming a groove in the refractory insert and forming a projecting portion on a side of the recess to interengage the groove when the refractory insert is disposed in the annular recess.

5. The method of claim 4 including forming the projecting portion to extend partially around the annular recess such that a predetermined arcuate extent of the annular recess is without the projecting portion.

6. The method of claim 5 including forming the projecting portion such that the predetermined arcuate extent of the annular recess that is without the projecting portion is slightly greater than the arcuate extent of the largest segment member of the refractory insert.

7. The method of claim 6 including forming the projecting portion on opposite surfaces of the recess and forming the groove in corresponding opposite sides of the refractory insert.

8. The method of claim 1 wherein the refractory insert is secured in the annular recess by passing a pin through a side of the recess into the refractory insert.

9. The method of claim 1 including flush mounting the refractory insert such that an exposed surface of the refractory insert is coplanar with the downstream end surface.

* * * * *

UNITED STATES PATENT AND TRADEMARK OFFICE

CERTIFICATE OF CORRECTION

PATENT NO. : 6,276,611 B1
DATED : August 21, 2001
INVENTOR(S) : Donald Duane Brooker et al.

It is certified that error appears in the above-identified patent and that said Letters Patent is hereby corrected as shown below:

Column 1,
Lines 24-24, change "U.S. Patent No. 4,491,456 to Schlinper (5 annulus fuel in to introduce" to -- U.S. Patent No. 4,491,456 to Schlinger (5 annulus fuel injector nozzle). The annulus type fuel injector nozzle is used to introduce --.

Column 2,
Line 6, change "Schlinyer" to -- Schlinger --.
Line 7, change "Schlinzer" to -- Schlinger --.
Line 13, change "Schlineer" to -- Schlinger --.

Column 6,
Line 64, change "locking pin 100" to -- locking pin 110 --.

Column 7,
Line 8, change "10" to -- 110 --.

Signed and Sealed this

Sixteenth Day of April, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,276,611 B1
DATED : August 21, 2001
INVENTOR(S) : Donald Duane Brooker et al.

It is certified that error appears in the above-identified patent and that said Letters Patent is hereby corrected as shown below:

Column 1,
Lines 24-25, change U.S. Patent No. 4,491,456 to Schlinper (5 annulus fuel in to introduce" to -- U.S. Patent No. 4,491,456 to Schlinger (5 annulus fuel injector nozzle). The annulus type fuel injector nozzle is used to introduce --.

Column 2,
Line 6, change "Schlinyer" to -- Schlinger --.
Line 7, change "Schlinzer" to -- Schlinger --.
Line 13, change "Schlineer" to -- Schlinger --.

Column 6,
Line 64, change "locking pin 100" to -- locking pin 110 --.

Column 7,
Line 8, change "10" to -- 110 --.

This certificate supersedes Certificate of Correction issued April 16, 2002.

Signed and Sealed this

Nineteenth Day of November, 2002

*Attest:*

*Attesting Officer*

JAMES E. ROGAN
*Director of the United States Patent and Trademark Office*